US010852063B2

(12) United States Patent
Mordovanaki et al.

(10) Patent No.: US 10,852,063 B2
(45) Date of Patent: Dec. 1, 2020

(54) MODULAR FURNACE

(71) Applicant: IMG-NA, LLC, Royal Oak, MI (US)

(72) Inventors: Elie G. Mordovanaki, Rochester Hills, MI (US); Yasir Bilal, Lasalle (CA)

(73) Assignee: IMG-NA, LLC, Royal Oak, MI (US)

( * ) Notice: Subject to any disclaimer, the term of this patent is extended or adjusted under 35 U.S.C. 154(b) by 137 days.

(21) Appl. No.: 15/995,188

(22) Filed: Jun. 1, 2018

(65) Prior Publication Data

US 2018/0347904 A1 Dec. 6, 2018

Related U.S. Application Data

(60) Provisional application No. 62/514,290, filed on Jun. 2, 2017.

(51) Int. Cl.

| | |
|---|---|
| ***F27B 9/18*** | (2006.01) |
| ***F27B 9/10*** | (2006.01) |
| ***F27B 9/02*** | (2006.01) |
| *F27D 1/00* | (2006.01) |

(52) U.S. Cl.
CPC ..... *F27B 9/185* (2013.01); *F27B 9/029* (2013.01); *F27B 9/10* (2013.01); *F27D 2001/005* (2013.01)

(58) Field of Classification Search
CPC ..... F27B 9/10; F27B 9/185; F27B 9/029
USPC ..... 266/171, 175, 176; 432/120, 121, 128, 432/142, 146, 213; 110/336
See application file for complete search history.

(56) References Cited

U.S. PATENT DOCUMENTS

| | | | | |
|---|---|---|---|---|
| 4,441,615 | A * | 4/1984 | Goodrich | B65D 21/041 206/505 |
| 4,702,694 | A * | 10/1987 | Johnson | F27B 9/185 34/178 |
| 4,912,301 | A * | 3/1990 | McKinney | C01G 21/02 219/388 |
| 5,741,131 | A | 4/1998 | DeGeorge et al. | |
| 5,756,043 | A * | 5/1998 | Coble | C21D 9/663 266/263 |
| 7,704,447 | B2 | 4/2010 | Danger et al. | |
| 9,115,413 | B2 * | 8/2015 | Grossi | F27B 9/185 |
| 9,423,182 | B2 | 8/2016 | Schwartz | |
| 9,493,856 | B2 | 11/2016 | Schwartz | |
| 2013/0273486 | A1 * | 10/2013 | Dvorak | F27D 7/00 432/9 |
| 2016/0024609 | A1 | 1/2016 | Locker et al. | |

FOREIGN PATENT DOCUMENTS

| | | |
|---|---|---|
| DE | 3743745 | 12/1987 |
| HU | E025061 | 12/2009 |

* cited by examiner

*Primary Examiner* — Scott R Kastler
*Assistant Examiner* — Michael Aboagye
(74) *Attorney, Agent, or Firm* — Carlson, Gaskey & Olds, P.C.

(57) ABSTRACT

An example furnace includes a plurality of furnace components that are stacked to form a plurality of furnace chambers therebetween. Each furnace component includes opposing sidewalls and a support wall that extends between the opposing sidewalls, separates adjacent ones of the plurality of furnace chambers, and defines a plurality of channels. A plurality of heating elements are situated in the channels.

17 Claims, 7 Drawing Sheets

MODULAR FURNACE

CROSS-REFERENCE TO RELATED APPLICATION

This application claims priority to U.S. Provisional Application No. 62/514,290, which was filed Jun. 2, 2017 and is incorporated herein by reference.

TECHNICAL FIELD

The present disclosure relates to furnaces, and more particularly to a furnace having a plurality of adjacent furnace chambers.

BACKGROUND

Hot forming is a process by which a metallic workpiece is heated to an elevated temperature in a furnace, and is then shaped to form a desired item, such as a part for a machine (e.g., doors, beams, and frames for automobiles). Constructing furnaces for hot forming has historically been costly and very labor intensive. Also, prior art furnaces have included workpiece supports that are prone to bowing and sagging, and have required cooling by air and/or water.

SUMMARY

A furnace according to an example of the present disclosure includes a plurality of furnace components that are stacked to form a plurality of furnace chambers therebetween. Each furnace component includes opposing sidewalls and a support wall that extends between the opposing sidewalls, separates adjacent ones of the plurality of furnace chambers, and defines a plurality of channels. A plurality of heating elements are situated in the channels.

A furnace according to an example of the present disclosure includes a plurality of furnace components that are stacked to form a plurality of furnace chambers therebetween. Each furnace component includes a first sidewall, a second sidewall opposite the first sidewall, and a support wall that connects the first and second sidewalls and separates adjacent ones of the plurality of furnace chambers. Each furnace component includes a first mating feature defined along an upper perimeter of the furnace component and a second mating feature defined along a lower perimeter of the furnace component that is different from the first mating feature. The first and second mating features of a given one of the furnace components interfit with respective adjacent furnace components.

A method according to an example of the present disclosure includes stacking a plurality of furnace components to form a plurality of furnace chambers therebetween. Each furnace component includes opposing sidewalls and a support wall that extends between the opposing sidewalls, separates adjacent ones of the plurality of furnace chambers, and defines a plurality of channels. The method includes inserting heating elements into the channels of the plurality of furnace components.

The embodiments described herein may be taken independently or in any combination. Features described in connection with one embodiment are applicable to all embodiments, unless such features are incompatible.

DETAILED DESCRIPTION

Figure 1:
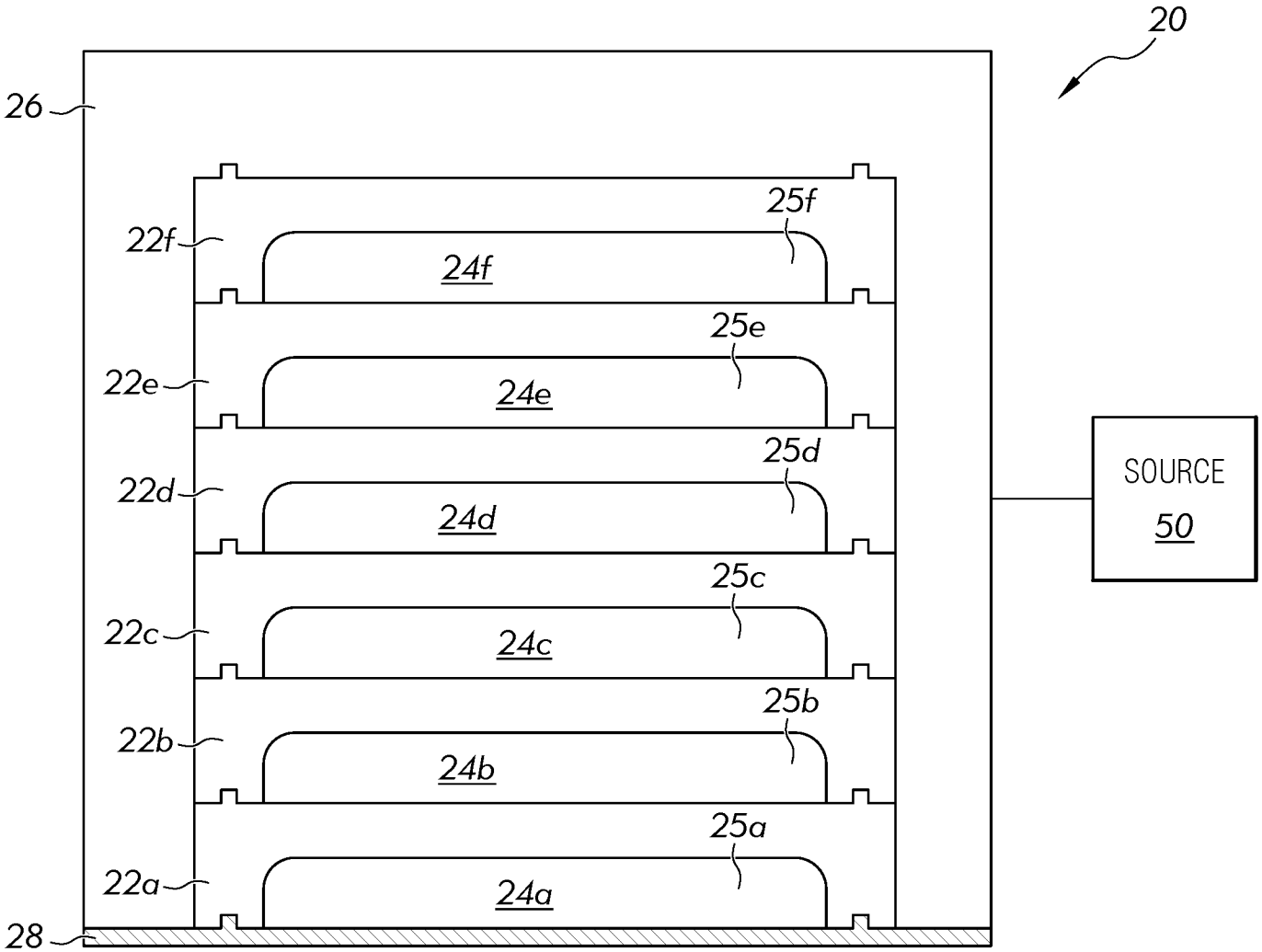
FIG. 1 schematically illustrates an example furnace.

FIG. 1 schematically illustrates a furnace 20, having a plurality of furnace components 22A-F that are vertically stacked to form a plurality of furnace chambers 24A-F therebetween. The chambers 24A-F may be used for heating metal sheets prior to "hot forming" those sheets into desired shapes, for example. Each furnace chamber 24A-F has an associated opening 25 for inserting objects to be heated into its associated furnace chamber 24. The furnace 20 includes an insulating outer layer 26, and an insulating lower layer 28. A source 50, such as a power or gas source, is used to heat the furnace chambers 24A-F. Although not shown in FIG. 1, doors could be included at the openings 25 for insulation and temperature control.

Figure 2:
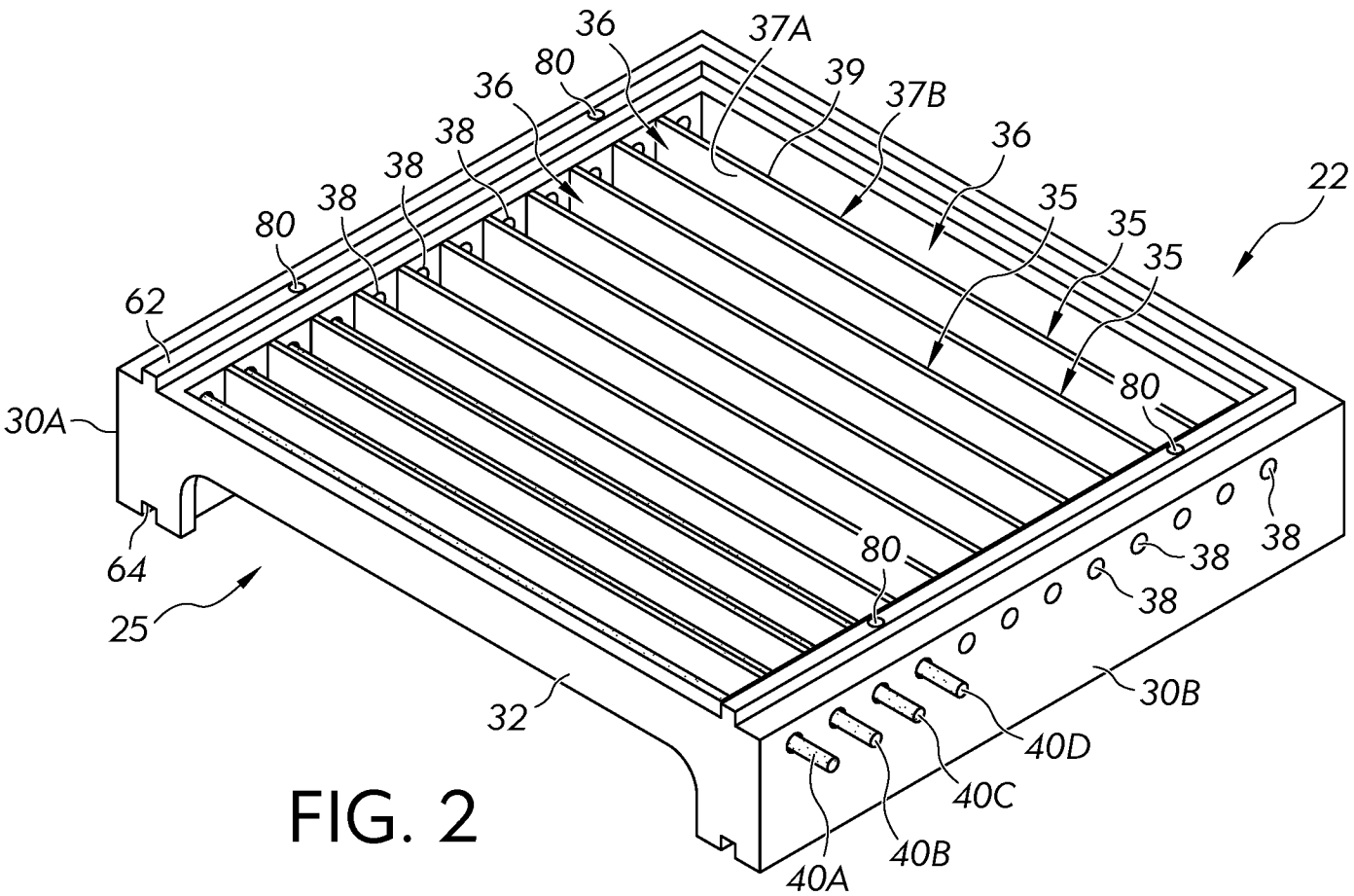
FIG. 2 schematically illustrates a first view of an example stackable furnace component for the furnace of FIG. 1 which includes a plurality of heating elements.

FIG. 2 schematically illustrates one of the furnace components 22 in greater detail. As shown in FIG. 2, the furnace component 22 includes opposing sidewalls 30A-B, and a support wall 32 that extends between the opposing sidewalls 30A-B, separates adjacent furnace chambers 24, and defines a plurality of channels 36. In the example of FIG. 2, the channels 36 extend between the opposing sidewalls 30A-B. The channels 36 are separated by dividers 35 having opposing faces 37A-B, each of which faces a respective one of the channels 36 (and if present in those channels, respective heating elements 40). A top side 39 of each divider wall 35 provide a support surface for items in an adjacent furnace chamber 24 above the furnace component 22.

The support wall 32 acts as a partition by separating adjacent furnace chambers 24. The sidewalls 30A-B each include respective openings 38 for receiving heating elements 40 into the channels 36. Although only four heating elements 40A-D are shown in FIG. 2 for simplicity, it is understood that other quantities of the heating elements 40 could be inserted into the channels 36 and openings 38 (e.g., insertion into all of the channels 36 and openings 38).

In the example of FIG. 2, the plurality of channels 36 are generally parallel to each other. Additionally, in the example of FIG. 2, the channels 36 comprise grooves in the top of the support wall 32 that open in an upward direction, such that the heating elements 40 situated in a given one of the furnace components 22 are operable to provide heating to a furnace chamber 24 immediately above the furnace component 22. As an example, the heating elements 40 that run through channels 36 in the furnace component 22B of FIG. 1 would provide heating for the furnace chamber 24C immediately above the furnace component 22B. Of course, it is understood that other configurations could be used (e.g., the channels 36 opening in a downward direction such that the rods in furnace component 22B provide heating for chamber 24B).

Figure 3:
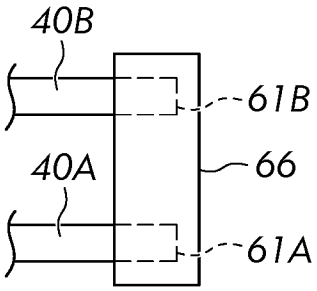
FIG. 3 schematically illustrates a device for electrically connecting heating element rods for the furnace component of FIG. 2.

In one example, the source 50 is an electrical power source, and the heating elements 40 are electric heating element rods heated by passing electrical current from the electrical power source 50 through the rods. FIG. 3 illustrates a connection device 66 that can be used to electrically connect adjacent heating element rods 40 to each other. In the example of FIG. 3, the device 66 includes blind holes 61A-B for receiving the ends of rods 40A-B.

In one example, the heating element rods 40 of a given furnace component 22 are connected in series to each other. In one such example, the heating element rods 40 of a given furnace component 22 are connected in a staggered fashion such that rods 40A-B are connected by a first device 66 adjacent to sidewall 30B, rods 40B-C are connected by a second device 66 adjacent wall 30A, rods 40C-D are connected by a third device 66 adjacent to sidewall 30B, etc. Of course, other types of electrical connections could be used (e.g., a parallel connection which uses an elongated version of the device 66 that connects to more than two of the rods 40).

In this disclosure, like reference numerals designate like elements where appropriate and reference numerals with the addition of one-hundred or multiples thereof designate modified elements that are understood to incorporate the same features and benefits of the corresponding elements.

Figure 4:
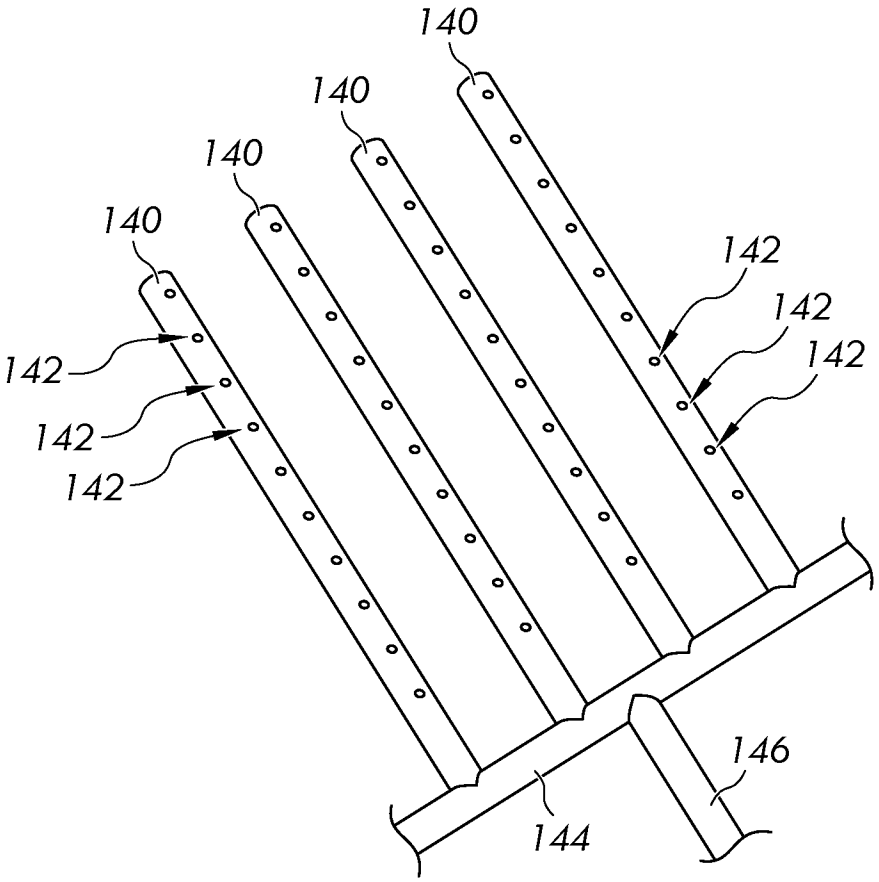
FIG. 4 schematically illustrates an example gas burner that can be used in the furnace component of FIG. 2.

FIG. 4 schematically illustrates an example in which the heating elements 140 disposed within the channels 36 are gas burner arms 140 that include a plurality of fuel outlets 142 through which combustible gas is emitted for burning. The gas burner arms 140 connect to a manifold 144 having an inlet 146 connected to the source 50, which is a source of combustible gas.

Figure 5:
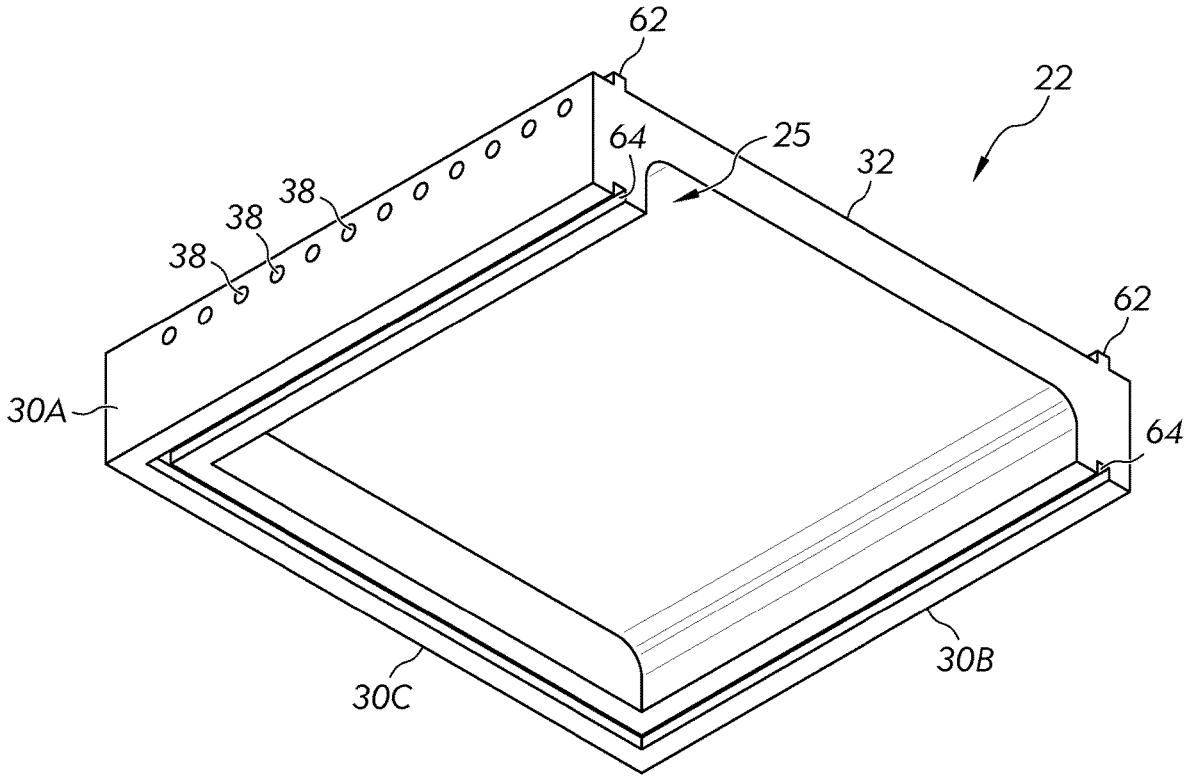
FIG. 5 schematically illustrates a second view of the stackable furnace component of FIG. 2.
Figure 6:
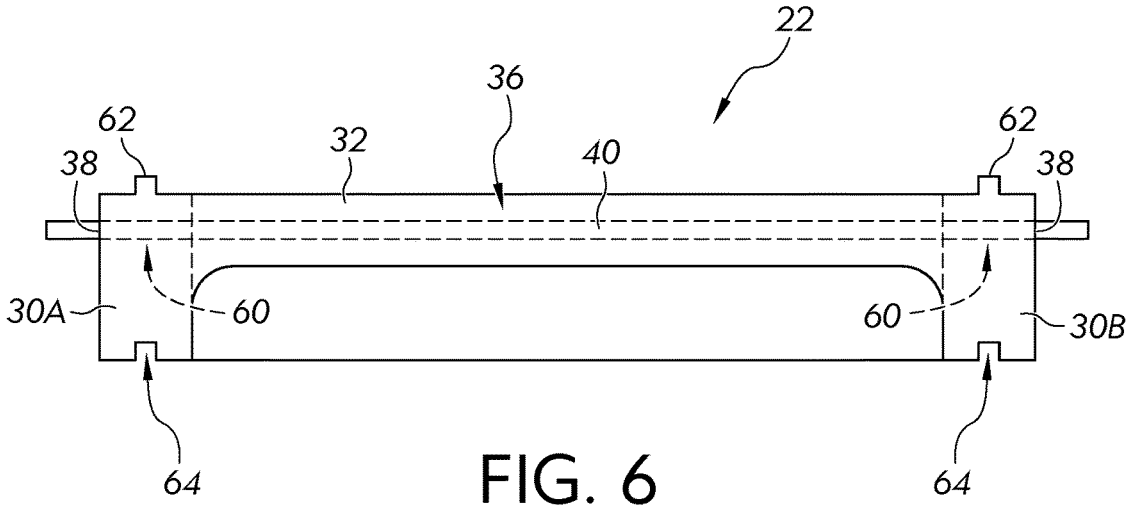
FIG. 6 schematically illustrates a third, cross-sectional view of the stackable furnace component of FIG. 2.

The furnace components 22 stack onto each other using a tongue 62 and groove 64 mating feature that is shown in FIGS. 2 and 5-6. In the depicted examples, the tongue 62 and groove 64 are each U-shaped, and extend along the sidewalls 30A-B and a rear wall 30C as well (see FIG. 5). Also, in the depicted examples the tongue 62 is situated on top of the walls 30A-C and the groove 64 is situated on the bottom of the walls 30A-C. Of course, it is understood that this is a non-limiting example that that the opposite configuration could be used if desired, with the tongue 62 on the bottom of the walls 30A-C and the groove 64 situated on the top. Also, it is understood that other mating features could be used instead of a tongue and groove feature in some examples. Although depicted as having rectangular cross-sections, the tongue 62 and groove 64 could have other shapes, such as a trapezoidal cross-sectional shape, for example.

Referring now to FIG. 6, a cross section of one of the furnace components 22 is shown. As shown in FIG. 6, the openings 38 in the sidewalls 30A-B open to respective passages 60 within which the heating element rod 40 rests. In one example, the heating element rods 40 are suspended within the channels 36 by resting within the passages 60 of the opposing sidewalls 30A-B.

Referring again to FIG. 1, in one example, the lowermost furnace chamber 24A lacks heating element rods 40 beneath it and is filled with insulation to minimize air pockets and prevent heat loss. Additionally, in the same or another example, the channels 36 of the uppermost furnace component 22F are also filled with insulation because there is no furnace chamber 24 immediately above that furnace component 22F. In a different example, where the channels 36 open downwards instead of upwards, and the heating element rods 40 situated in a given furnace component 22 heat the furnace chamber 24 of that component 22 instead of the furnace chamber 24 above the furnace component 22, such insulation could be omitted.

In one example, the furnace components 22 are made from a casting material, such as an alumina and mullite-based castable refractory. In a further example, the castable refractory has a high content of aluminum oxide ($Al_2O_3$) (e.g., greater than 50%) and includes metallic reinforcement fibers. In a further example, the ceramic mix is at least partially composed of ARMORMAX® 70 SR from Allied Mineral Products, which is includes $Al_2O_3$ (70.1%), $SiO_2$ (25.5%), CaO (2.1%), $TiO_2$ (1.1%), $Fe_2O_3$ (0.6%) and Alkalies (0.3%). ARMORMAX® 70 SR has exceptional structural and thermal properties that makes it useful for the construction of such furnace. Of course, it is understood that this is a non-limiting example and that other materials could be used.

In a further example, the ceramic mix is at least partially composed of a mullite-based refractory such as METAL-ROK® 70M from Allied Mineral products, which includes $Al_2O_3$ (70.2%), $SiO_2$ (25.4%), CaO (2.2%), $TiO_2$ (1.1%), $Fe_2O_3$ (0.7%), Alkalies (0.3%), and MgO (0.1%). The heating element rods 40 may be composed of steel or a steel alloy in some examples.

Use of a mold to form the furnace components 22 can lower production costs and provide uniformity between the components. Castable units are cost effective to produce in quantities and produce an accurate repeatable product, because the furnace components 22 will be identical coming off the same mold. In the prior art, molds were not used causing a lack of uniformity between furnaces, and manual labor costs were also high.

In one example, the insulating outer layer 26 of FIG. 1 includes a ceramic fiber module, such as a PYRO-BLOC® Y Module. In one example, the insulating lower layer 28 of FIG. 1 includes a calcium silicate board. Of course, it is understood that these and the preceding materials are only examples, and that other materials could be used.

Referring again to the example of FIG. 2, each furnace component 22 includes a plurality of cavities 80 into which anchor screws may be secured for lifting the furnace components 22.

Although not shown in the figures, doors could be installed on the front of each furnace chamber 24 at the opening 25 which is opposite the rear wall 30C, so that the individual furnace chambers 24 can be enclosed and avoid heat loss.

Figure 7:
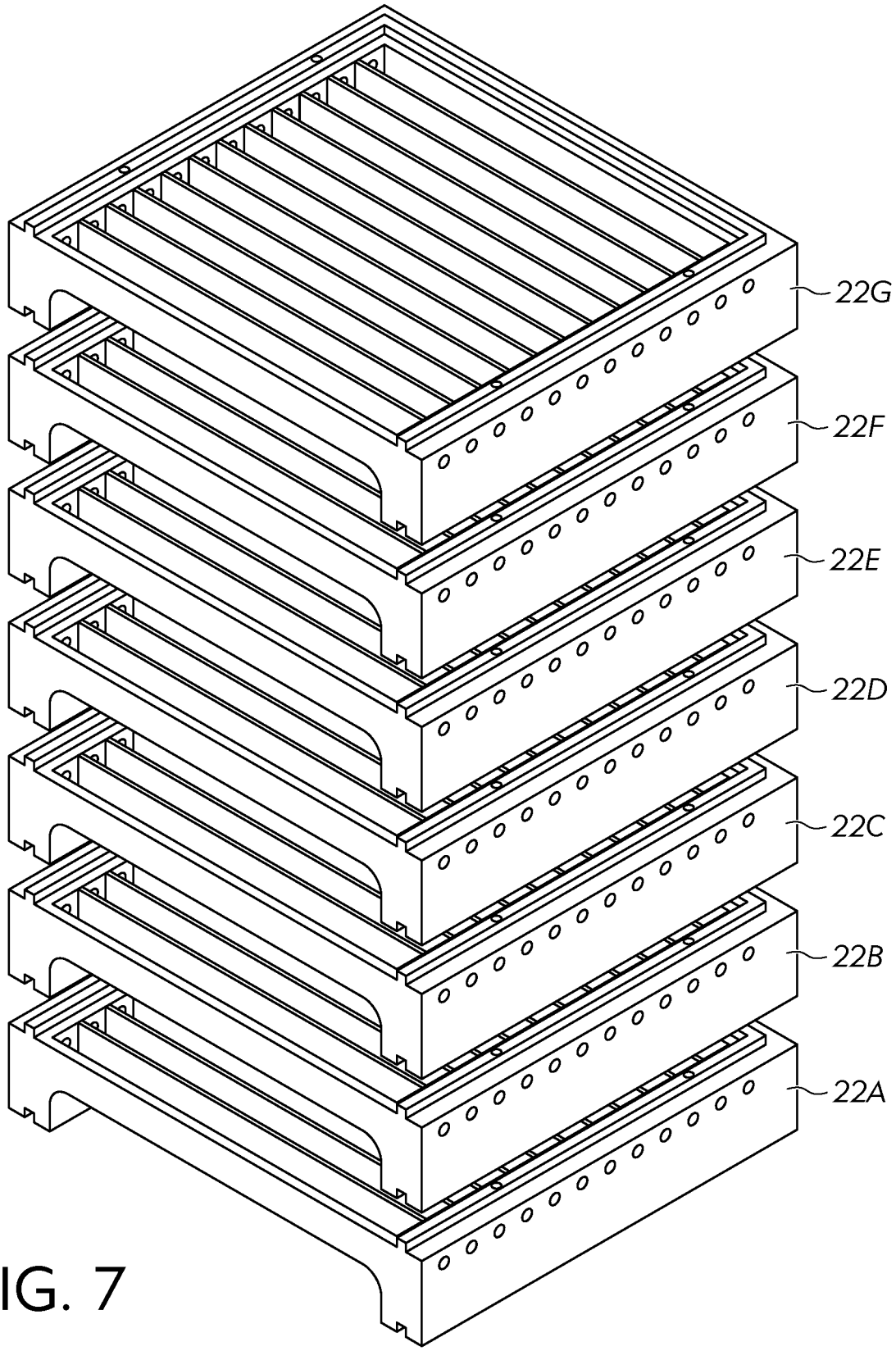
FIG. 7 is an exploded perspective view of a plurality of the furnace components of FIG. 2.

FIG. 7 illustrates an exploded perspective view of how a plurality of the furnace components 22A-G may be stacked on top of each other in a modular fashion.

Figure 8:
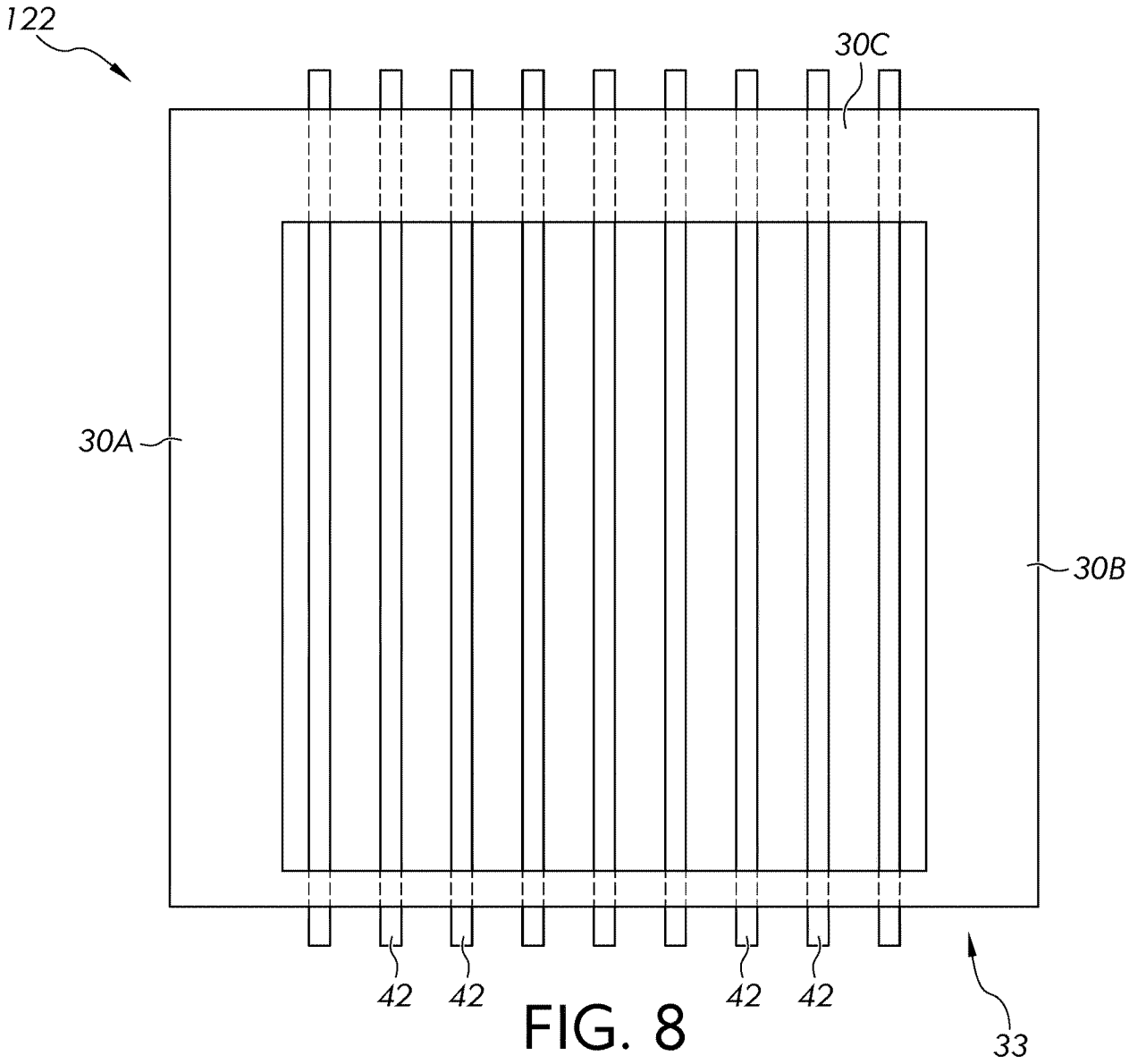
FIG. 8 schematically illustrates another example orientation for the heating elements of the furnace component of FIG. 2.

FIG. 8 schematically illustrates a top view of a furnace component 122 that utilizes a different orientation for heating elements 42 (or 142). In the example of FIG. 8, the heating elements 40 extend between the rear sidewall 30C and a front side 33 of the furnace component of 22, and are generally parallel to the sidewalls 30A-B. Although omitted for simplicity in FIG. 8, it is understood that the dividers 35 could also be included for defining channels 36 in which the heating elements 42 reside.

Figure 9:
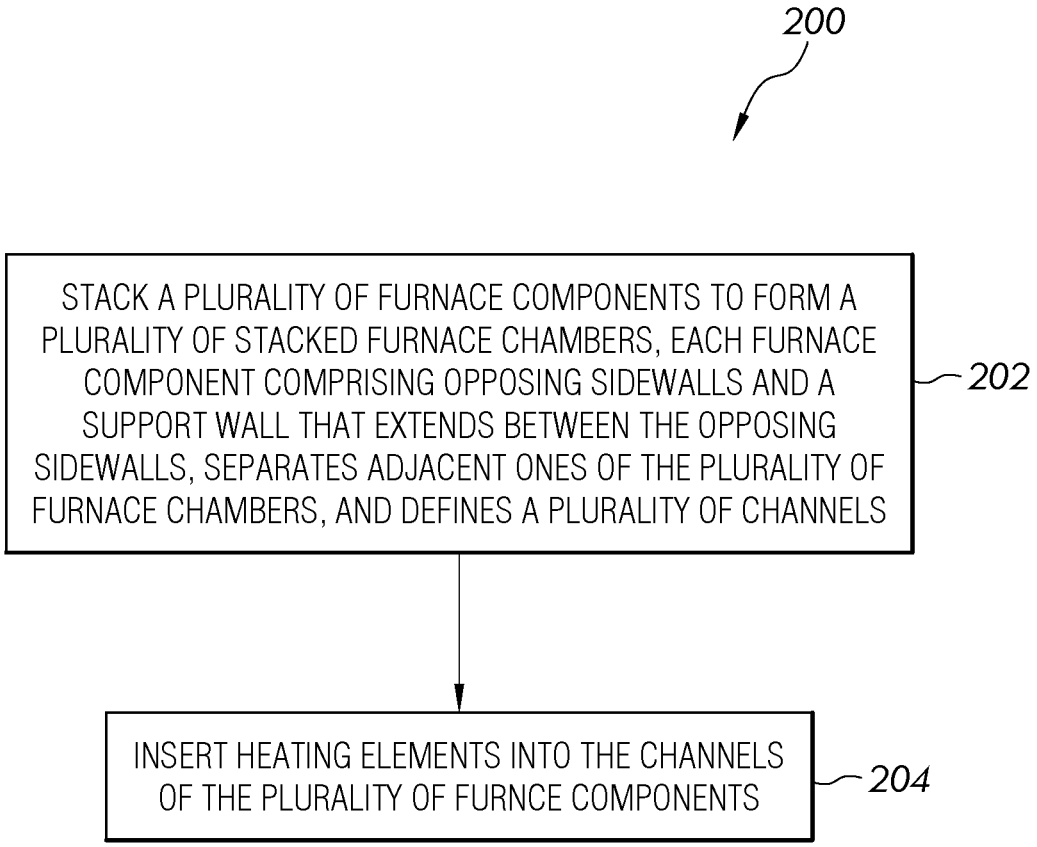
FIG. 9 schematically illustrates a method of forming a furnace.

FIG. 9 schematically illustrates a method 200 of forming a furnace. A plurality of furnace components 22 are stacked (block 202) to form a plurality of stacked furnace chambers 24, with each furnace component 22 including opposing sidewalls 30A-B and a support wall 32 that extends between the opposing sidewalls 30A-B, separates adjacent ones of the plurality of furnace chambers 24, and defines a plurality of channels 36. Heating elements 40 are inserted into the channels 36 of the plurality of furnace components (block 204).

The heating elements 40 are heated using the source 50 (e.g., which provides either electrical power or combustible gas) to heat the furnace chambers 24.

Although the examples shown above have illustrated six vertically stacked furnace components 22 (FIG. 1) and seven vertically stacked furnace components 22 (FIG. 7), it is understood that other quantities could be used that are greater than seven or less than six.

The stackable furnace components 22 facilitate the construction of furnaces in a modular fashion which is efficient and cost-effective, with lower labor expenses than prior art furnaces. Additionally, the discrete furnace chambers 24 are isolated from each other, and can in some embodiments facilitate independent temperature control, such that various ones of the furnace chambers 24 are maintained at different operating temperatures. The furnace components 22 also provide good temperature uniformity within the furnace chambers 24. Still further, the workpiece supports of the prior art that were prone to sagging and/or bowing can be omitted in the designs discussed herein if desired, which can lower maintenance costs. Use of a casting mold to form the furnace components 22 provides consistent dimensions between the furnace components 22, which in combination with the stacking features discussed above make the overall furnace 20 geometrically stable and less susceptible to movement over prolonged exposure to temperature, and reduces process downtime and waste.

Although example embodiments have been disclosed, a worker of ordinary skill in this art would recognize that certain modifications would come within the scope of the claims. For that reason, the following claims should be studied to determine their true scope and content.

What is claimed is:

1. A method comprising: stacking a plurality of furnace components to provide a plurality of furnace chambers that are vertically aligned; each furnace component comprising opposing first and second sidewalls, a rear side wall, and a support wall, wherein the support wall extends from the first sidewall and along the rear wall to the second sidewall; and defines a plurality of channels that extend between the opposing first and second sidewalls; and inserting heating elements into the channels of the plurality of furnace components; wherein for each of the furnace components one of the furnace chambers is provided between the first and second sidewalls; and wherein for at least one of the furnace components, the support wall is configured as a base for one of the furnace chambers provided above the at least one of the furnace components.

2. The method of claim 1, wherein said stacking a plurality of furnace components to provide a plurality of stacked furnace chambers that are vertically aligned comprises: interfitting a first mating feature along an upper perimeter of a given one of the furnace components with a mating feature of a first adjacent one of the plurality of furnace components to define at least a portion of a first one of the furnace chambers; and interfitting a second mating feature along a lower perimeter of the given one of the furnace components with a mating feature of a second adjacent one of the plurality of furnace components to define at least a portion of a second one of the furnace chambers.

3. The method of claim 1, wherein said inserting heating elements into the channels of the plurality of furnace components comprises:

inserting heating element rods into the channels; and electrically coupling the rods to each other outside of the furnace components.

4. The method of claim 1, wherein said inserting heating elements into the channels of the plurality of furnace components comprises:

inserting gas burners into the channels; and connecting the gas burners to a fuel source outside of the furnace components.

5. A furnace, comprising: a plurality of furnace components that are stacked to form a plurality of furnace chambers that are vertically aligned; each furnace component comprising opposing first and second sidewalls, a rear sidewall, and a support wall, wherein the support wall extends from the first sidewall and along the rear wall to the second sidewall; and defines a plurality of channels that extend between the opposing first and second sidewalls; and a plurality of heating elements situated in the channels; wherein for each of the furnace components one of the furnace chambers is provided between the first and second sidewalls; and wherein for at least one of the furnace components, the support wall is configured as a base for one of the furnace chambers provided above the at least one of the furnace components.

6. The furnace of claim 5, wherein the plurality of heating elements comprise electrical heating element rods.

7. The furnace of claim 5, wherein the plurality of heating elements comprise gas burners.

8. The furnace of claim 5, wherein the plurality of channels are generally parallel to each other.

9. The furnace of claim 5, wherein the heating elements are suspended in the channels through openings in the opposing first and second sidewalls.

10. The furnace of claim 5, wherein each support wall comprises a plurality of dividers that separate the channels of the support wall.

11. The furnace of claim 10, wherein the dividers include respective top sides that provide a support surface for items in an adjacent furnace chamber.

12. The furnace of claim 5, wherein the channels comprise grooves in a top or bottom of each support wall that open to one of the plurality of furnace chambers, such that the heating elements situated in the channels of a given furnace component provide heating to said one of the plurality of furnace chambers.

13. The furnace of claim 5:

wherein each of the plurality of furnace components comprises a first mating feature along a portion of its upper perimeter, and a second mating along a portion of its lower perimeter; and wherein a first of the first and second mating features comprises a tongue, and a second of the first and second mating features comprises a groove sized to receive the tongue of an adjacent furnace component.

14. The furnace of claim 5, wherein each furnace component is formed from a casted ceramic material.

15. The furnace, of claim 5, wherein:

each furnace component comprises a first mating feature defined along an upper perimeter of the furnace component and a second mating feature defined along a lower perimeter of the furnace component that is different from the first mating feature; and the first and second mating features of a given one of the furnace components interfit with respective adjacent furnace components.

16. The furnace of claim 15:

wherein the first mating feature of the given one of the furnace components interfits with the second mating feature of a first adjacent one of the plurality of furnace components; and the second mating feature of the given one of the furnace components interfits with the first mating feature of a second adjacent one of the plurality of furnace components.

17. The furnace of claim 5, wherein for the at least one of the furnace components, the support wall is also configured as a ceiling for the furnace chamber provided between the sidewalls of the at least one of the furnace components.

* * * * *